US005340008A

United States Patent [19]

Freermann et al.

[11] Patent Number: 5,340,008

[45] Date of Patent: Aug. 23, 1994

[54] FABRIC CONVEYOR SYSTEM

[75] Inventors: Johannes Freermann; Dieter Malcherek, both of Ochtrup, Fed. Rep. of Germany

[73] Assignee: Carl Schmale GmbH & Co. KG, Ochtrup, Fed. Rep. of Germany

[21] Appl. No.: 924,024

[22] PCT Filed: Feb. 22, 1991

[86] PCT No.: PCT/DE91/00150

§ 371 Date: Aug. 24, 1992

§ 102(e) Date: Aug. 24, 1992

[87] PCT Pub. No.: WO91/13016

PCT Pub. Date: Sep. 5, 1991

[30] Foreign Application Priority Data

Mar. 2, 1990 [DE] Fed. Rep. of Germany ..... 9002430

[51] Int. Cl.[5] ..... B65H 20/06

[52] U.S. Cl. ..... 226/171

[58] Field of Search ..... 226/170, 171, 176

[56] References Cited

U.S. PATENT DOCUMENTS

| | | | |
|---|---|---|---|
| 3,140,030 | 7/1964 | Stewart | 226/171 X |
| 3,482,840 | 12/1969 | Cytrin | 226/170 |
| 4,707,158 | 11/1987 | Hofmann | 226/171 X |
| 4,817,845 | 4/1989 | Franchuk | 226/176 X |

FOREIGN PATENT DOCUMENTS

| | | |
|---|---|---|
| 3216949 | 11/1983 | Fed. Rep. of Germany . |
| 3844581 | 2/1990 | Fed. Rep. of Germany . |
| 2133966 | 12/1972 | France . |
| 659513 | 10/1951 | United Kingdom . |

*Primary Examiner*—John M. Jillions

*Attorney, Agent, or Firm*—Herbert Dubno; Yuri Kateshov

[57] ABSTRACT

A fabric conveyor system for a textile web includes a plurality of guiding rollers pressing against one side of the web, a toothed driven belt pressed against the opposite side the web, and a plurality of pressure pads supporting a toothed side of the driven belt turned away from the opposite side of the web and formed with respective flank portions each providing an unsupported run for a maximum of one tooth.

6 Claims, 1 Drawing Sheet

FABRIC CONVEYOR SYSTEM

CROSS REFERENCE TO RELATED APPLICATIONS

This application is a national phase of PCT/DE/91/00150 filed 22 Feb. 1991 and based, in turn, upon German national application G 90 02 430.3 filed 2 Mar. 1990.

FIELD OF THE INVENTION

Our present invention relates to a fabric conveyor system, particularly for automatic cutting and sewing installations for textile webs or the like, whereby a textile web or individual pieces of material are conveyed, preferably at their edges, by continuous conveyors such as driven belts towards work stations such as stations for folding, hemming selvedge consolidation or the like, and whereby the textile web travels between endless belts and a stationary rail, or stationary freely rotatable rollers, and whereby means are provided for pressing the textile web against the stationary rail, or rollers and the belt lying with its flat side against the textile web is supported on its respective opposite side by a plurality of elastic pressure pads.

BACKGROUND OF THE INVENTION

A fabric conveyor system of the above-described kind is known from DE-A-38 44 581.

Such fabric conveyor systems are frequently used in automatic textile machines of all kinds. In such systems it is most important to guide the textile goods precisely to and between the work stations, in order to avoid irregularities. These irregularities can occur due to the slippage of the textile goods between the guides, but also due to the slippage of the smooth belt from its drive disk. When textile goods are referred to here, generally we include in the definition any kind of flat goods made of any material such as textile, plastic, cardboard, etc.

Special difficulties are encountered in guiding textile webs when the thickness of these webs varies. The slippage of the drive belt from its drive disk results in uneven belt speeds, which in turn produce irregularities in the goods at the work station. When the belt portion between the guide rollers sags, variations in the contact pressure on the textile web occur over lengths of several meters.

From DE-A-38 44 581 a fabric conveyor system is known in which a smooth, flat belt is used as a continuous conveyor.

In this system, it is possible that slippage can occur between the guide or driving rollers and the belt, which can lead to irregularities in the guidance of the material.

Furthermore, this construction requires a pressure means, which presses the smooth face of the conveyor belt against the workpiece. For this purpose in a boxlike hollow profile a pressure means in the form of an inflatable pressure hose is provided, which can act upon a pressure-transmitting member consisting for instance of elements subdivided in the longitudinal direction. This element subdivided in longitudinal direction can be formed by a band element having individual segments connected to each other by elastic webs. As already described above, this arrangement does not insure a slippage-free entrainment between the guide or driving rollers and the endless belt of the continuous conveyor.

In addition considerable manufacturing and structural expenses are related to the arrangement of the pressure-medium-actuatable hose, including the pressure member actuated by the hose. Also the adjustment to the variable thickness of the running textile web or the like may not be satisfactory. In earlier systems it has been proposed to provide several pressure hoses as pressure elements which can be differently actuated. However this allows only an insufficient degree of adjustment of the individual segments of the pressure-transmitting element.

Hence it is essential for the individual elements of the pressure-transmitting member not to be in fact separate elements, but at least elements connected to each other by elastic webs.

OBJECT OF THE INVENTION

It is the object of the present invention to provide a fabric conveyor system capable of guiding the goods precisely over longer stretches and with variable thickness of the goods and to ensure the absence of slippage to a large extent at a uniform contact pressure of the web of material.

SUMMARY OF THE INVENTION

This object is attained, in accordance with the invention, in a fabric conveyor system, particularly for automatic cutting and sewing installations in textile webs or the like, whereby the textile webs are guided, preferably at their edges by continuous conveyors such as driven belts toward work stations such as stations for the folding, hemming, selvage consolidating or the like. The textile web is guided between endless belts or between a stationary rail or an endless belt or stationary freely rotatable rollers or an endless belt, with means for pressing the textile web against the stationary rail, a belt or the rollers are provided.

A belt lies with its flat side against the textile web and is supported on its opposite side by a plurality of elastic pressure pads.

The belt is a toothed belt and the elastic pressure pads pressing against the tooth side of the belt are arranged in the longitudinal direction of the belt next to each other so a maximum of one tooth facing the pressure pads remains without support on the surface of the pressure pads in each gap between pressure pads.

The pressure pads can be arranged not only over a part of the belt width but over the entire effective length of the belt.

Each pressure pad can have a slot arranged approximately in the middle of its longitudinal dimension and transverse to the longitudinal direction, engaging a holding pin which limits the uppermost position of the pressure pad.

On both sides of the holding pin, compression springs are provided which are guided in blind holes of the pressure pad and in blind holes of a stationary bar parallel to the pressure pads on a side thereof facing away form the belt. The pressure pads can have inclined approach edges in the direction of oncoming teeth of the toothed belt.

BRIEF DESCRIPTION OF THE DRAWING

The above and other objects, features and advantages of the invention will become more readily apparent from the following description, reference being made to the accompanying highly diagrammatic drawing in which.

SPECIFIC DESCRIPTION

Figure 1:
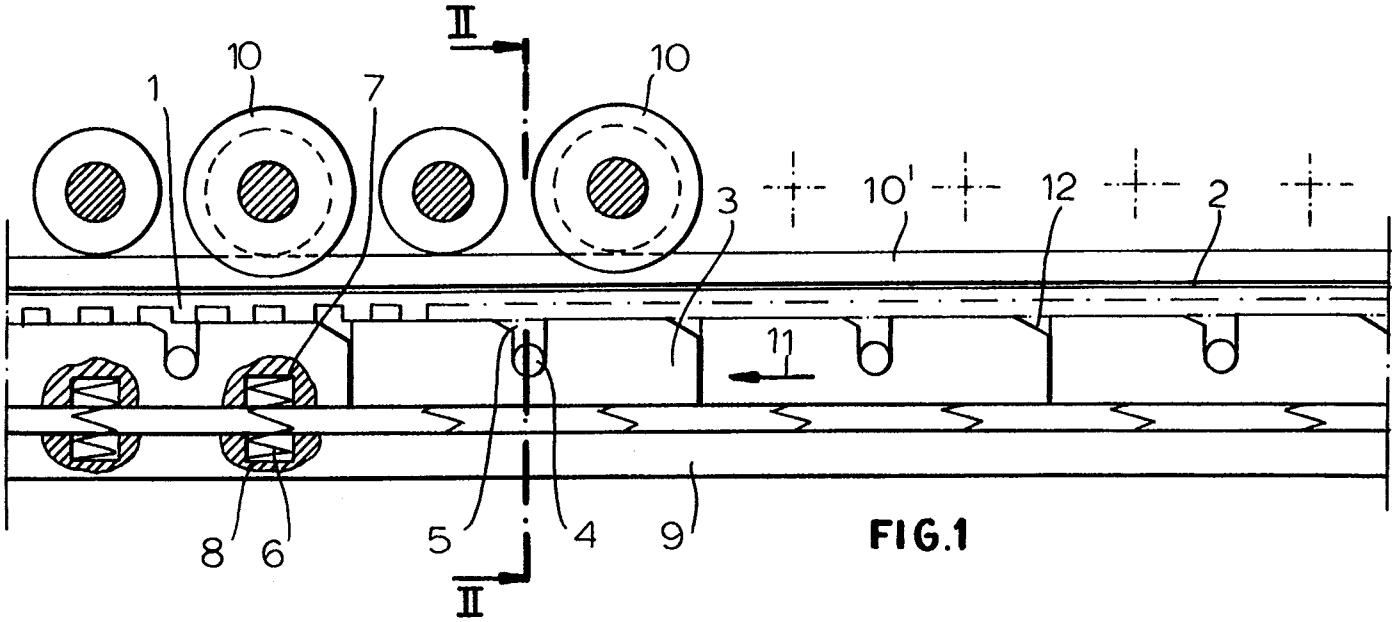
FIG. 1 is a lateral view of the fabric conveyor in partial section.

FIG. 1 shows is a lateral view of a fabric conveyor according to the invention. A textile web 2 is guided at its edges by an endless toothed belt 1 between the latter and upper guide rollers 10. The toothed belt 1 travels in the direction of arrow 11. On the toothed side of toothed belt 1 a plurality of elastic pressure pads 3 are arranged, which hit against each other with their ends in the longitudinal direction of the belt and provide a supporting contact with the downwards pointing blunt tooth surfaces of toothed belt 1.

The toothed belt 1 is guided over guide rollers (not shown) which are designed like toothed disks and of which at least one is driven. A belt 10' is provided between the guide rollers 10 and the web 2.

The pressure pads 3 are provided over the entire effective belt length. The length of the individual pressure pads 3 is selected in relation with the tooth distribution of toothed belt 1, so that a maximum of one tooth with its surface facing the pressure pad 3 remains without contact with the surface of pressure pad 3 at any gap in the support provided by the surfaces of the pressure pad. In this way, when a tooth leaves the surface of the pressure pad, there is always a subsequent tooth which comes in touch with it.

Each pressure pad 3 is provided approximately in the middle with a slot 5 which engages with a holding pin 4 when the pressure pad 3 has reached its uppermost position. On both sides of holding pin 4, compression springs 6 are provided which are guided in blind holes 7, 8, provided on one side in the pressure pad and on the other side in a stationary bar 9. The pressure pads 3 are provided with a sloped edge 12 on the side approached by the toothed belt in the direction of arrow 11, in order to prevent the locking of a tooth against pressure pad 3.

Figure 2:
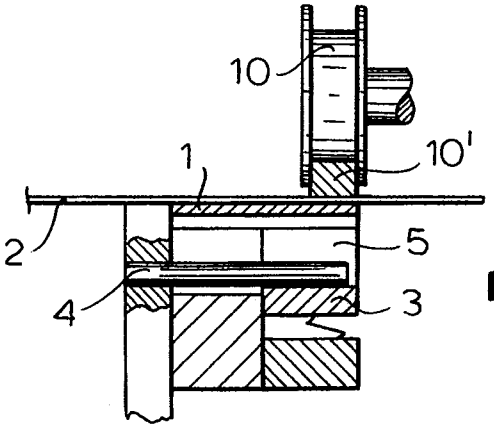
FIG. 2 is a section along the line II—II in FIG. 1.

FIG. 2 shows a cross section along II—II in FIG. 1. The pin 4 and the bar 9 are stationary, fixed to the machine frame. In the sectioned pressure pad 3, one can recognize the slot 5 with the pin 4 engaging therein. The toothed belt 1 rests upon the pressure pad 3. The textile web 2 is guided by the upper guide rollers 10.

We claim:

1. A fabric conveyor, comprising:

a support surface against which a web can be pressed at an edge of said web on one side thereof, and extending along a transport path for said web;

an endless belt bearing with an outer surface against another side of said web opposite said one side and running along said transport path, said belt being formed on an inner side thereof turned away from said other side of the web with uniformly spaced apart teeth;

a succession of pressure pads extending over substantially an entire effective length of the belt engaging said web along said transport path, said pressure pads having downstream flanks with respect to a direction of travel of the belt and the web along said transport path;

support means for individually supporting said pressure pads, said pads having portions adjacent said flanks inclined toward said belt in said direction of travel and providing an unsupported run of the belt and dimensioned such that no more than one tooth of the teeth of the belt is located at the respective portion of each pressure pad; and spring means individually bearing upon said pads and urging same against said teeth to support said belt over said effective length for yieldable movement of said pads and said belts toward and away from said support surface.

2. The fabric conveyor defined in claim 1 wherein each pressure pad is formed with a respective slot opening toward said support surface and having a respective downstream portion providing a respective unsupported run of the belt, said slots having widths in said direction dimensioned with respect to the spacing of said teeth such that no more than one tooth of the teeth of the belt is located at the said portion of each slot, said portions of said slots being inclined toward said belt in said direction of travel and each of the slots receiving a pin forming the respective support means.

3. The fabric conveyor defined in claim 2 wherein said support surface is provided with an array of rollers extending along said transport path.

4. The fabric conveyor defined in claim 3, further comprising a roller belt interposed between said array of rollers and said endless belt.

5. The fabric conveyor defined in claim 2 wherein said spring means includes a pair of springs received in blind bores of each pad, braced against a stationary bar disposed along a side of said pads turned away from said belt, and flanking each slot.

6. The fabric conveyor defined in claim 2 wherein each of said pins in each of said slots is positioned to limit movement of the respective pad toward said support surface.

* * * * *